US009493262B2

(12) United States Patent
Lancaster, III et al.

(10) Patent No.: US 9,493,262 B2
(45) Date of Patent: Nov. 15, 2016

(54) MACHINE GENERATED WRAP DATA

(75) Inventors: Patrick R. Lancaster, III, Louisville, KY (US); Michael Mitchell, Louisville, KY (US); Thomas Harris, Louisville, KY (US); Robert D. Janes, Sr., Louisville, KY (US)

(73) Assignee: Lantech.com, LLC, Louisville, KY (US)

( * ) Notice: Subject to any disclaimer, the term of this patent is extended or adjusted under 35 U.S.C. 154(b) by 987 days.

(21) Appl. No.: 13/284,528

(22) Filed: Oct. 28, 2011

(65) Prior Publication Data

US 2012/0102887 A1 May 3, 2012

Related U.S. Application Data

(60) Provisional application No. 61/408,543, filed on Oct. 29, 2010.

(51) Int. Cl.

| | |
|---|---|
| ***B65B 11/00*** | (2006.01) |
| ***B65B 57/18*** | (2006.01) |
| ***B65B 11/02*** | (2006.01) |
| ***B65B 11/04*** | (2006.01) |

(52) U.S. Cl.

CPC ..... *B65B 57/18* (2013.01); *B65B 11/025* (2013.01); *B65B 11/045* (2013.01); *B65B 2011/002* (2013.01); *B65B 2210/18* (2013.01); *B65B 2210/20* (2013.01)

(58) Field of Classification Search

CPC ..... B65B 11/00; B65B 67/08; B65B 11/045; B65B 11/02; B65B 11/008; B65B 9/135; B65B 11/025; B65B 11/48; B65B 11/50; B65D 71/0088

USPC ..... 53/461, 580, 399

See application file for complete search history.

(56) References Cited

U.S. PATENT DOCUMENTS

| | | | |
|---|---|---|---|
| 2,227,398 | A | 12/1940 | Mohl |
| 2,904,196 | A | 9/1959 | Teixeira |

(Continued)

FOREIGN PATENT DOCUMENTS

| | | |
|---|---|---|
| DE | 3634924 | 4/1988 |
| DE | 4234604 | 4/1994 |

(Continued)

OTHER PUBLICATIONS

European Patent Office; Search Report and Written Opinion in International Patent Application No. PCT/US2011/058393 dated Feb. 14, 2012; 11 pages.

(Continued)

*Primary Examiner* — Andrew M Tecco
*Assistant Examiner* — Chelsea Stinson
(74) *Attorney, Agent, or Firm* — Middleton Reutlinger

(57) ABSTRACT

A method for generating data with a wrapping machine during wrapping of a load includes measuring a length of packaging material dispensed during wrapping of the load with a sensing assembly on the wrapping machine. The method further includes obtaining a value indicative of a weight of the packaging material per unit of length and determining a weight of the packaging material dispensed on the wrapped load based on the measured length and the obtained value without removing the packaging material from the load. The determined weight of the packaging material is displayed on a display device.

17 Claims, 3 Drawing Sheets

(56) References Cited

U.S. PATENT DOCUMENTS

| | | | | |
|---|---|---|---|---|
| 3,029,571 | A | 4/1962 | Douthit | |
| 3,815,313 | A | 6/1974 | Heisler | |
| 3,867,806 | A * | 2/1975 | Lancaster, III | B65B 11/585 53/441 |
| 4,077,179 | A * | 3/1978 | Lancaster | B65B 11/045 100/15 |
| 4,152,879 | A | 5/1979 | Shulman | |
| 4,216,640 | A | 8/1980 | Kaufman | |
| 4,235,062 | A | 11/1980 | Lancaster, III et al. | |
| 4,271,657 | A | 6/1981 | Lancaster, III et al. | |
| 4,300,326 | A | 11/1981 | Stackhouse | |
| 4,387,548 | A | 6/1983 | Lancaster et al. | |
| 4,395,255 | A | 7/1983 | Branecky et al. | |
| 4,418,510 | A | 12/1983 | Lancaster, III et al. | |
| 1,432,185 | A | 2/1984 | Geisinger | |
| 4,458,467 | A | 7/1984 | Shulman et al. | |
| 4,497,159 | A | 2/1985 | Lancaster, III | |
| 4,501,105 | A | 2/1985 | Rogers et al. | |
| 4,503,658 | A | 3/1985 | Mouser et al. | |
| 4,505,092 | A | 3/1985 | Bowers et al. | |
| 4,514,955 | A * | 5/1985 | Mouser et al. | 53/64 |
| 4,545,182 | A * | 10/1985 | McDowell, Jr. | B65B 13/10 53/556 |
| 4,590,746 | A | 5/1986 | Humphrey | |
| 4,676,048 | A | 6/1987 | Lancaster et al. | |
| 4,693,049 | A | 9/1987 | Humphrey | |
| 4,712,354 | A | 12/1987 | Lancaster et al. | |
| 4,754,594 | A | 7/1988 | Lancaster | |
| 4,761,934 | A | 8/1988 | Lancaster | |
| 4,807,427 | A | 2/1989 | Casteel et al. | |
| 4,840,006 | A | 6/1989 | Humphrey | |
| 4,845,920 | A | 7/1989 | Lancaster | |
| 4,862,678 | A | 9/1989 | Humphrey | |
| 4,866,909 | A | 9/1989 | Lancaster, III et al. | |
| 4,905,451 | A | 3/1990 | Jaconelli et al. | |
| 4,953,336 | A | 9/1990 | Lancaster, III et al. | |
| 4,991,381 | A | 2/1991 | Simons | |
| 5,040,356 | A | 8/1991 | Thimon | |
| 5,040,359 | A | 8/1991 | Thimon | |
| 5,054,263 | A | 10/1991 | Maki-Rahkola et al. | |
| 5,054,987 | A | 10/1991 | Thornton | |
| 5,077,956 | A | 1/1992 | Thimon | |
| 5,107,657 | A | 4/1992 | Diehl et al. | |
| 5,123,230 | A | 6/1992 | Upmann | |
| 5,138,817 | A | 8/1992 | Mowry et al. | |
| 5,186,981 | A | 2/1993 | Shellhamer et al. | |
| 5,195,296 | A | 3/1993 | Matsumoto | |
| 5,195,297 | A | 3/1993 | Lancaster et al. | |
| 5,195,301 | A | 3/1993 | Martin-Cocher et al. | |
| 5,203,136 | A | 4/1993 | Thimon et al. | |
| 5,203,139 | A | 4/1993 | Salsburg et al. | |
| 5,216,871 | A | 6/1993 | Hannen | |
| 5,240,198 | A | 8/1993 | Dorfel | |
| 5,301,493 | A | 4/1994 | Chen | |
| 5,311,725 | A | 5/1994 | Martin et al. | |
| 5,315,809 | A | 5/1994 | Gordon et al. | |
| 5,369,416 | A | 11/1994 | Haverty et al. | |
| 5,414,979 | A | 5/1995 | Moore et al. | |
| 5,447,008 | A | 9/1995 | Martin-Cocher | |
| 5,450,711 | A | 9/1995 | Martin-Cocher | |
| 5,463,842 | A | 11/1995 | Lancaster | |
| 5,524,413 | A | 6/1996 | Fukuda | |
| 5,546,730 | A | 8/1996 | Newell et al. | |
| 5,572,855 | A | 11/1996 | Reigrut et al. | |
| 5,595,042 | A | 1/1997 | Cappi et al. | |
| 5,653,093 | A | 8/1997 | Delledonne | |
| 5,671,593 | A | 9/1997 | Ginestra et al. | |
| 5,765,344 | A | 6/1998 | Mandeville et al. | |
| 5,768,862 | A | 6/1998 | Mauro et al. | |
| 5,799,471 | A | 9/1998 | Chen | |
| 5,836,140 | A | 11/1998 | Lancaster, III | |
| 5,875,617 | A | 3/1999 | Scherer | |
| 5,884,453 | A | 3/1999 | Ramsey et al. | |
| 5,953,888 | A | 9/1999 | Martin-Cocher et al. | |
| 6,082,081 | A | 7/2000 | Mucha | |
| 6,195,968 | B1 | 3/2001 | Marois et al. | |
| 6,253,532 | B1 | 7/2001 | Orpen | |
| 6,293,074 | B1 | 9/2001 | Lancaster, III et al. | |
| 6,314,333 | B1 | 11/2001 | Rajala et al. | |
| 6,360,512 | B1 | 3/2002 | Marois et al. | |
| 6,370,839 | B1 | 4/2002 | Nakagawa et al. | |
| 6,453,643 | B1 | 9/2002 | Buscherini et al. | |
| 6,516,591 | B1 | 2/2003 | Lancaster, III et al. | |
| 6,698,161 | B1 | 3/2004 | Rossi | |
| 6,748,718 | B2 | 6/2004 | Lancaster, III et al. | |
| 6,826,893 | B2 | 12/2004 | Cere | |
| 6,848,240 | B2 | 2/2005 | Frey | |
| 6,851,252 | B2 | 2/2005 | Maki-Rahkola et al. | |
| 6,918,229 | B2 | 7/2005 | Lancaster, III et al. | |
| 7,040,071 | B2 | 5/2006 | Heikaus | |
| 7,114,308 | B2 * | 10/2006 | Cox | 53/399 |
| 7,386,968 | B2 * | 6/2008 | Sperry et al. | 53/411 |
| 7,568,327 | B2 | 8/2009 | Lancaster, III et al. | |
| 7,707,801 | B2 | 5/2010 | Lancaster, III | |
| 7,707,901 | B2 | 5/2010 | Lancaster, III et al. | |
| 7,779,607 | B2 | 8/2010 | Lancaster, III et al. | |
| 8,001,745 | B2 | 8/2011 | Carter et al. | |
| 8,037,660 | B2 | 10/2011 | Lancaster, III et al. | |
| 8,276,346 | B2 | 10/2012 | Lancaster, III et al. | |
| 8,276,354 | B2 | 10/2012 | Lancaster, III et al. | |
| 8,739,502 | B2 | 6/2014 | Lancaster, III et al. | |
| 2003/0110737 | A1 | 6/2003 | Lancaster et al. | |
| 2003/0145563 | A1 | 8/2003 | Cere | |
| 2003/0200732 | A1 | 10/2003 | Maki-Rahkola et al. | |
| 2004/0031238 | A1 | 2/2004 | Cox | |
| 2004/0040477 | A1 | 3/2004 | Neumann | |
| 2005/0044812 | A1 | 3/2005 | Lancaster et al. | |
| 2005/0115202 | A1 | 6/2005 | Mertz et al. | |
| 2006/0213155 | A1 | 9/2006 | Forni et al. | |
| 2006/0248858 | A1 | 11/2006 | Lancaster | |
| 2006/0254225 | A1 | 11/2006 | Lancaster et al. | |
| 2006/0289691 | A1 | 12/2006 | Forni | |
| 2007/0204564 | A1 | 9/2007 | Lancaster et al. | |
| 2007/0204565 | A1 | 9/2007 | Lancaster et al. | |
| 2007/0209324 | A1 | 9/2007 | Lancaster, III et al. | |
| 2008/0216449 | A1 | 9/2008 | Zimmerli | |
| 2008/0295614 | A1 | 12/2008 | Lancaster, III et al. | |
| 2009/0178374 | A1 | 7/2009 | Lancaster, III et al. | |
| 2009/0293425 | A1 * | 12/2009 | Carter | B65B 11/025 53/167 |
| 2010/0239403 | A1 | 9/2010 | Lancaster, III et al. | |
| 2010/0300049 | A1 | 12/2010 | Schmidt et al. | |
| 2010/0303526 | A1 | 12/2010 | Hayase | |
| 2011/0131927 | A1 | 6/2011 | Lancaster, III et al. | |
| 2011/0146203 | A1 | 6/2011 | Lancaster, III et al. | |
| 2011/0179752 | A1 | 7/2011 | Lancaster, III et al. | |
| 2012/0031053 | A1 | 2/2012 | Lancaster, III et al. | |
| 2012/0102886 | A1 | 5/2012 | Lancaster, III et al. | |
| 2012/0102887 | A1 | 5/2012 | Lancaster, III et al. | |
| 2012/0124944 | A1 | 5/2012 | Lancaster, III et al. | |
| 2013/0061558 | A1 | 3/2013 | Klear et al. | |
| 2013/0076753 | A1 | 3/2013 | Lancaster, III et al. | |
| 2014/0116006 | A1 | 5/2014 | Lancaster, III et al. | |
| 2014/0116007 | A1 | 5/2014 | Lancaster, III et al. | |
| 2014/0116008 | A1 | 5/2014 | Lancaster, III et al. | |
| 2014/0223864 | A1 * | 8/2014 | Lancaster, III | B65B 11/008 53/436 |

FOREIGN PATENT DOCUMENTS

| | | |
|---|---|---|
| EP | 0096635 | 12/1983 |
| EP | 0466980 | 1/1992 |
| EP | 0671324 | 9/1995 |
| EP | 0811554 | 12/1997 |
| EP | 1125841 | 8/2001 |
| EP | 1213223 | 6/2002 |
| EP | 1489004 | 12/2004 |
| EP | 1705119 | 9/2006 |
| EP | 1717149 | 11/2006 |
| EP | 1736426 | 12/2006 |

(56) References Cited

FOREIGN PATENT DOCUMENTS

| | | | |
|---|---|---|---|
| GB | 2107668 | | 5/1983 |
| JP | 2001072012 | | 3/2001 |
| JP | 2004161344 | | 6/2004 |
| WO | 9420367 | | 9/1994 |
| WO | 9700202 | | 1/1997 |
| WO | 9822346 | | 5/1998 |
| WO | 2004069659 | | 8/2004 |
| WO | 2007071593 | | 6/2007 |
| WO | 2007100596 | A2 | 9/2007 |
| WO | 2007100597 | | 9/2007 |
| WO | 2008007189 | | 1/2008 |
| WO | 2008115868 | | 9/2008 |
| WO | 2008129432 | | 10/2008 |
| WO | 2011057166 | | 5/2011 |
| WO | 2012058549 | | 5/2012 |
| WO | 2012058596 | | 5/2012 |

OTHER PUBLICATIONS

"The Technology Behind a 'No-Tear', 'No-Rip' Film Carriage, and How to Explain it to your Customers," Jan. 21, 2010, downloaded from http://wulftecstretchwrapper.blogspt.com/2010_01_01archive.html on Jan. 7, 2011; 4 pages.

U.S. Patent and Trademark Office; Office Action issued in related U.S. Appl. No. 14/808,751 dated Jan. 13, 2016.

U.S. Patent and Trademark Office; Final Office Action issued in related U.S. Appl. No. 14/808,751 dated Apr. 8, 2016.

European Patent Office; Search Report and Written Opinion in International Patent Application No. PCT/US2012/056270 dated Jan. 3, 2013; 7 pages.

U.S. Patent and Trademark Office, Office Action issued in related U.S. Appl. No. 13/623,500 dated Nov. 17, 2014.

U.S. Patent and Trademark Office, Final Office Action issued in related U.S. Appl. No. 13/623,500 dated Mar. 27, 2015.

* cited by examiner

MACHINE GENERATED WRAP DATA

CROSS-REFERENCE TO RELATED APPLICATIONS

This application claims the filing benefit of U.S. Provisional Patent Application Ser. No. 61/408,543 filed on Oct. 29, 2010, which is incorporated by reference herein in its entirety.

TECHNICAL FIELD

The present disclosure relates to methods and apparatus for wrapping loads with a wrapping machine, and more particularly, for generating wrap data with the wrapping machine.

BACKGROUND

An important consideration when wrapping loads with packaging material, and then shipping the wrapped loads, is whether the packaging material is applied to the load with enough layers to generate a level of containment force on the load that is adequate for keeping the load intact during shipping. This must be weighed against other considerations including, for example, the weight and cost of packaging material used to wrap each load. Determining the effectiveness of packaging materials for wrapping loads requires an understanding of these and other considerations.

For many reasons, the effectiveness of packaging materials for wrapping loads is difficult to quantify and predict. In production facilities where loads are wrapped with packaging material, typically no methods are employed to measure the requirements or characteristics of an effectively wrapped load, since operators of such facilities focus on meeting shipment rates rather than on determining the quality of wrapping on the loads in those shipments.

In some instances, data has been generated manually after wrapping of a load using measuring devices including, for example, containment force measuring tools and scales. However, due to the time and effort required to generate and analyze such data, generating and analyzing the data is often ignored, increasing the likelihood that a wrapped load that is transported may have a containment force below that which is needed for successfully transporting the wrapped load, and thus, risking failure of the wrapped load during transport. Such failures may be costly since the load may be damaged or may damage transportation equipment, and/or may cause delays or missed deliveries. Failing to generate and analyze data may also lead to loads being wrapped with more packaging material than is actually needed, leading to inefficiency and higher costs.

In other instances, data has been generated by cutting packaging material off of a wrapped load and performing analyses on the cut packaging material. Generating data this way is wasteful and time consuming. And since cutting the packaging material off of every wrapped load is not desirable, cutting is typically performed on a single test load, and an assumption is made that the results are consistent for subsequent loads. This may not be the case, however, if the characteristics of the loads being wrapped vary, if the packaging material is changed, or if wrap settings are adjusted.

Another difficulty arises due to there being several packaging material manufacturers in the marketplace, many offering several different types of packaging materials, as well as variants of those types. All of these different packaging materials may have different characteristics that impact their effectiveness for wrapping loads. In addition, a first operator of a wrapping machine may use settings that are different from those used by a second operator of the wrapping machine, thus adding further variability to the process. The number of potential combinations of variables adds to the complexity of determining the effectiveness of packaging materials.

The present disclosure is directed to overcoming one or more of the above-noted problems.

SUMMARY

According to an embodiment of the present invention, a method for generating data with a wrapping machine during wrapping of a load includes measuring a length of packaging material dispensed during wrapping of the load with a sensing assembly on the wrapping machine. The method further includes obtaining a value indicative of a weight of the packaging material per unit of length and determining a weight of the packaging material dispensed on the wrapped load based on the measured length and the obtained value without removing the packaging material from the load. The determined weight of the packaging material is displayed on a display device.

According to another embodiment of the present invention, a method of generating data with a wrapping machine during wrapping of a load includes determining a number of relative revolutions between the packaging material dispenser and the load during wrapping of the load with a sensing assembly on the wrapping machine. The wrapping machine includes the packaging material dispenser. The method further includes determining a number of layers on a face of the load based on the number of relative revolutions. The method further includes determining a height of the packaging material dispenser relative to the load during each relative revolution and determining a height of each layer based on the height of the packaging material dispenser relative to the load during each relative revolution. The method further includes displaying a graph during wrapping of the load with a display device, the graph including an axis indicative of the face of the load and one or more indicators along the axis indicative of the number of layers on the face of the load and the height of each layer on the face of the load.

According to another embodiment of the present invention, a wrapping machine includes a controller for generating data during wrapping of a load. The wrapping machine further includes a packaging material dispenser configured to dispense packaging material around the load and a length sensing assembly for measuring packaging material dispensed during wrapping. The wrapping machine further includes a display device, and the controller is configured to determine the length of the packaging material dispensed during wrapping and to generate a first output signal to the display device corresponding to the determined length.

Additional objects and advantages of the present disclosure will be set forth in part in the description which follows, and in part will be obvious from the description, or may be learned by practice of the present disclosure. The objects and advantages of the present disclosure will be realized and attained by means of the elements and combinations particularly pointed out in the appended claims.

It is to be understood that both the foregoing general description and the following detailed description are exemplary and explanatory only and are not restrictive of the present disclosure, as claimed.

The accompanying drawings, which are incorporated in and constitute a part of this specification, illustrate embodiments of the present disclosure and together with the description, serve to explain the principles of the present disclosure.

DESCRIPTION OF THE EMBODIMENTS

Reference will now be made in detail to embodiments of the present disclosure, examples of which are illustrated in the accompanying drawings. Wherever possible, the same reference numbers will be used throughout the drawings to refer to the same or like parts. The disclosures of each of U.S. Patent Application Publication No. 2009/0178374, entitled "ELECTRONIC CONTROL OF METERED FILM DISPENSING IN A WRAPPING APPARATUS," filed Jan. 7, 2009; U.S. Pat. No. 7,707,901, entitled "APPARATUS AND METHOD FOR MEASURING CONTAINMENT FORCE IN A WRAPPED LOAD AND A CONTROL PROCESS FOR ESTABLISHING AND MAINTAINING A PREDETERMINED CONTAINMENT FORCE PROFILE," filed Apr. 21, 2008; U.S. Pat. No. 7,779,607, entitled "WRAPPING APPARATUS INCLUDING METERED PRE-STRETCH FILM DELIVERY ASSEMBLY," filed Feb. 23, 2007; U.S. Pat. No. 7,568,327, entitled "METHOD AND APPARATUS FOR SECURING A LOAD TO A PALLET WITH A ROPED FILM WEB," filed Jan. 30, 2004; U.S. Patent Application Publication No. 2007/0209324, entitled "METHOD AND APPARATUS FOR SECURING A LOAD TO A PALLET WITH A ROPED FILM WEB," filed Feb. 23, 2007, are incorporated herein by reference in their entirety. Examples and descriptions of the disclosure are also set forth in the disclosure materials that are included as part of this application and are incorporated herein by reference.

Figure 1:
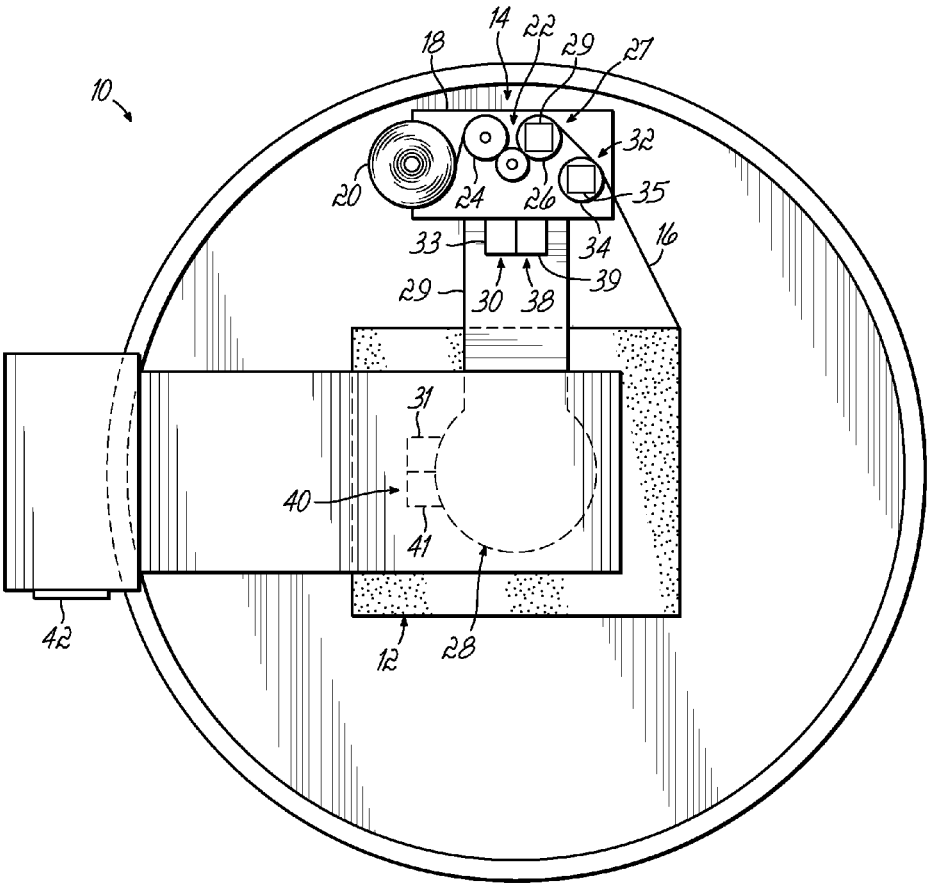
FIG. 1 is a top view of a wrapping machine, according to an aspect of the present disclosure.

According to one aspect of this disclosure, a wrapping machine 10 for wrapping a load 12 is shown in FIG. 1. The wrapping machine 10 may include a packaging material dispenser 14 for dispensing packaging material 16. The packaging material dispenser 14 may include a roll carriage 18 configured to support a roll 20 of the packaging material 16. The packaging material 16 may include stretch wrap packaging material. Stretch wrap packaging material has a high yield coefficient to allow the material to undergo stretching during wrapping. Alternatively, the packaging material 16 may include netting, strapping, banding, or tape.

The packaging material dispenser 14 may also include one or more packaging material dispensing rollers 22 configured to receive packaging material 16 from the roll 20 and dispense the packaging material 16 for application to the load 12. The one or more packaging material dispensing rollers 22 may be driven for rotation about their respective longitudinal axes by a drive system (not shown) including, for example, an electric motor or any other suitable power source, similar to that which is described in U.S. Patent Application Publication No. 2009/0178374.

The one or more packaging material dispensing rollers 22 may include prestretch rollers 24 and 26. The prestretch rollers 24 and 26 are configured to stretch the packaging material 16 before the packaging material 16 is dispensed to the load 12. The prestretch rollers 24 and 26 stretch the packaging material 16 by engaging a portion of the packaging material 16 with the upstream prestretch roller 24, which rotates at a slower speed than the downstream prestretch roller 26, while also engaging a portion of the packaging material 16 with the downstream prestretch roller 26. The disparity between the rotational speeds of the prestretch rollers 24 and 26 causes stretching of the portion of the packaging material 16 between the prestretch rollers 24 and 26.

The wrapping machine 10 may also include a relative rotation assembly 28 for providing relative rotation between the packaging material dispenser 14 and the load 12. The relative rotation assembly 28 may include a drive system 31 including, for example, an electric motor or any other suitable power source, similar to that which is described in U.S. Patent Application Publication No. 2009/0178374. The relative rotation assembly 28 may also include a rotating arm 29, a rotatable turntable (not shown), or a rotating ring (not shown), powered by the drive system, as described in U.S. Patent Application Publication No. 2009/0178374.

The wrapping machine 10 may also include a vertical drive assembly 30 for providing relative vertical movement between the packaging material dispenser 14 and the load 12. The vertical drive assembly 30 may include a drive system 33 including, for example, an electric motor or any other suitable power source, similar to that which is described in U.S. Patent Application Publication No. 2009/0178374. The combined operation of the vertical drive assembly 30 and the relative rotation assembly 28 carries the packaging material dispenser 14 along a substantially spiral path relative to the load 12 to spirally wrap the packaging material 16 around the load 12.

Figure 5:
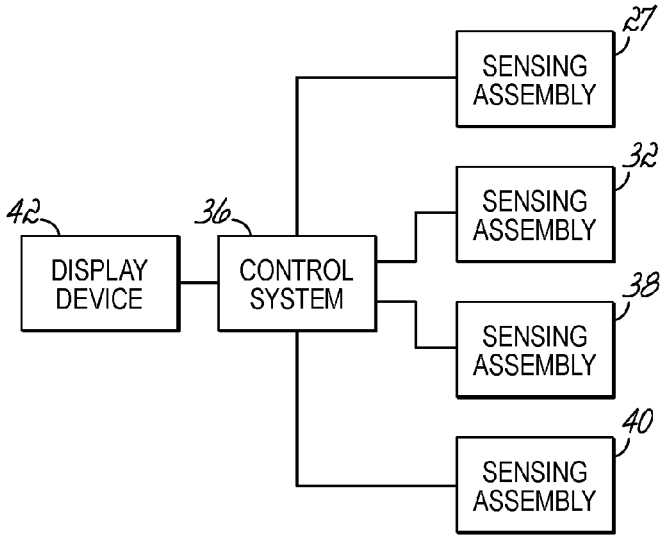
FIG. 5 is a schematic diagram depicting a control system, sensing assemblies, and a display device according to an aspect of the present disclosure.

The wrapping machine 10 includes a sensing assembly 27 configured to sense a length of the packaging material 16 dispensed to the load 12. The sensing assembly 27 may be similar to the sensing assembly described in U.S. Patent Application Publication No. 2009/0178374. In the exemplary embodiment shown, the sensing assembly 27 includes prestretch roller 26, described above, the rotation of which provides an indication of an amount of the packaging material 16 dispensed from the packaging material dispenser 14 to the load 12. The sensing assembly 27 may also include a sensing device 29 for sensing rotation of prestretch roller 26. The sensing device 29 may include any suitable reader, encoder, transducer, detector, or sensor capable of sensing rotation of prestretch roller 26. Signals from the sensing assembly 27, indicative of the sensed rotation of prestretch roller 26, may be sent to a control system 36 of the wrapping machine 10, as shown in FIG. 5. The sensing assembly features described above are exemplary, and it is contemplated that in addition to, or as an alternative to, the above described features, a photoeye, proximity detector, laser distance measurer, ultrasonic distance measurer, electronic rangefinder, and/or any other suitable distance measuring device, may be used.

The wrapping machine 10 may include a sensing assembly 32 configured to sense a characteristic of the packaging material 16. The sensing assembly 32 may be similar to the sensing assembly described in U.S. Patent Application Publication No. 2009/0178374. For example, the sensing assembly 32 may include a roller 34, which may be an idle or unpowered roller, which is rotatably mounted on the packaging material dispenser 14. The roller 34 may engage the packaging material 16 between prestretch roller 26 and the load 12. Thus, rotation of the roller 34 may provide an indication of a demand for packaging material at the load 12. The sensing assembly 32 may also include a sensing device 35 for sensing rotation of the roller 34. The sensing device 35 may include any suitable reader, encoder, transducer, detector, or sensor capable of sensing rotation of the roller 34. Signals from the sensing assembly 32, indicative of the sensed rotation of the roller 34, may be sent to a control system 36 of the wrapping machine 10, as shown in FIG. 5. The sensing assembly features described above are exemplary, and it is contemplated that in addition to, or as an alternative to, the above described features, a photoeye, proximity detector, laser distance measurer, ultrasonic distance measurer, electronic rangefinder, and/or any other suitable distance measuring device, may be used.

The wrapping machine 10 may also include a sensing assembly 38 configured to sense a height of at least a portion of the packaging material dispenser 14 relative to the load 12. The portion of the packaging material dispenser 14 may include, for example, the roll carriage 18. The sensing assembly 38 may include a sensing device 39 configured to sense the height of the portion of the packaging material dispenser 14 relative to the load 12, and provide a signal indicative of the relative height to the control system 36. The sensing device 39 may include any suitable reader, encoder, transducer, detector, or sensor capable of determining the height of the portion of the packaging material dispenser 14 relative to the load 12.

The wrapping machine 10 may also include a sensing assembly 40 configured to sense the relative rotation of the packaging material dispenser 14 relative to the load 12 that is provided by the relative rotation assembly 28. The sensing assembly 40 may include a sensing device 41 configured to sense rotation of the electric motor or other power source driving the relative rotation, and provide a signal indicative of the relative rotation to the control system 36. The sensing assembly 40 may include any suitable encoder, transducer, reader, detector, or sensor.

The control system 36 may include a processor, a computer, or any other suitable computing and controlling device configured to run software and control machine operations. The control system 36 may receive signals from the sensing assemblies 27, 32, 38, and 40 and make determinations based thereon, and may also be configured to control operation of the packaging material dispenser 14, relative rotation assembly 28, and vertical drive assembly 30, by sending instruction signals to the drive systems in those assemblies, similar in manner to what is described in U.S. Patent Application Publication No. 2009/0178374.

Figure 2:
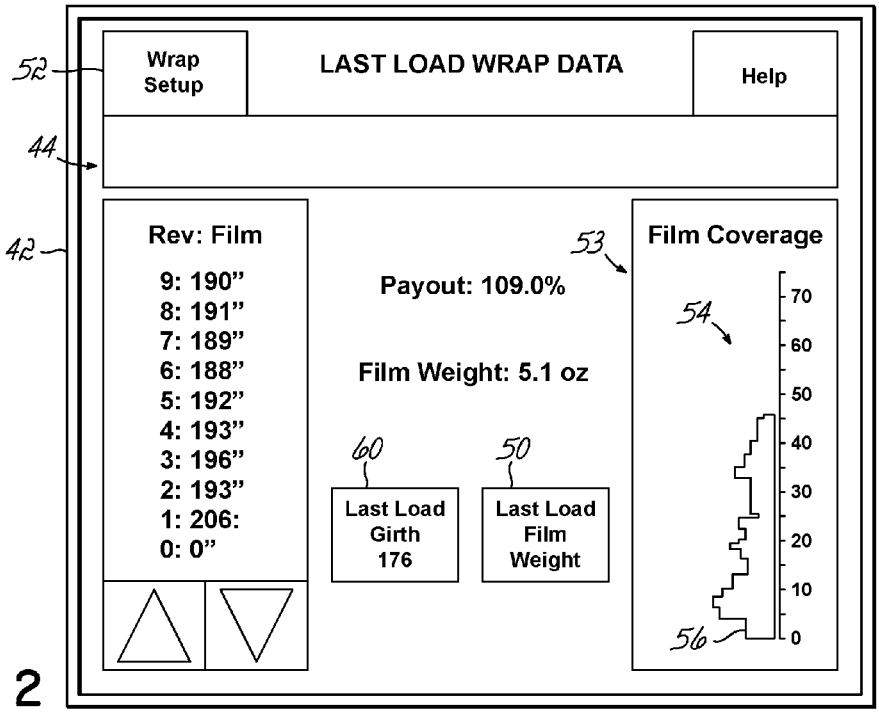
FIG. 2 is an exemplary screen shot on a display device, according to an aspect of the present disclosure.
Figure 3:
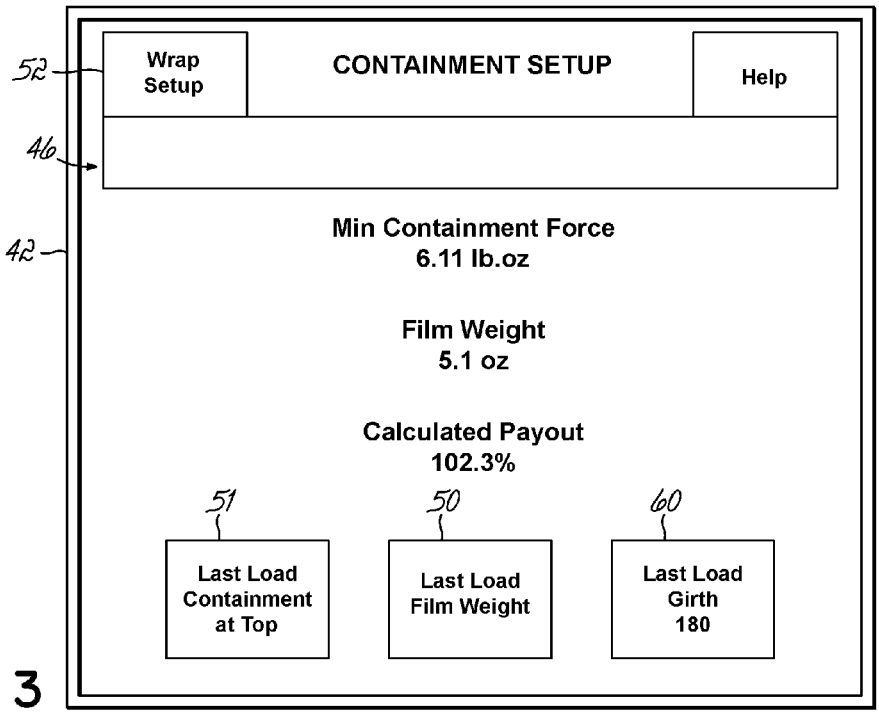
FIG. 3 is another exemplary screen shot on a display device, according to an aspect of the present disclosure.
Figure 4:
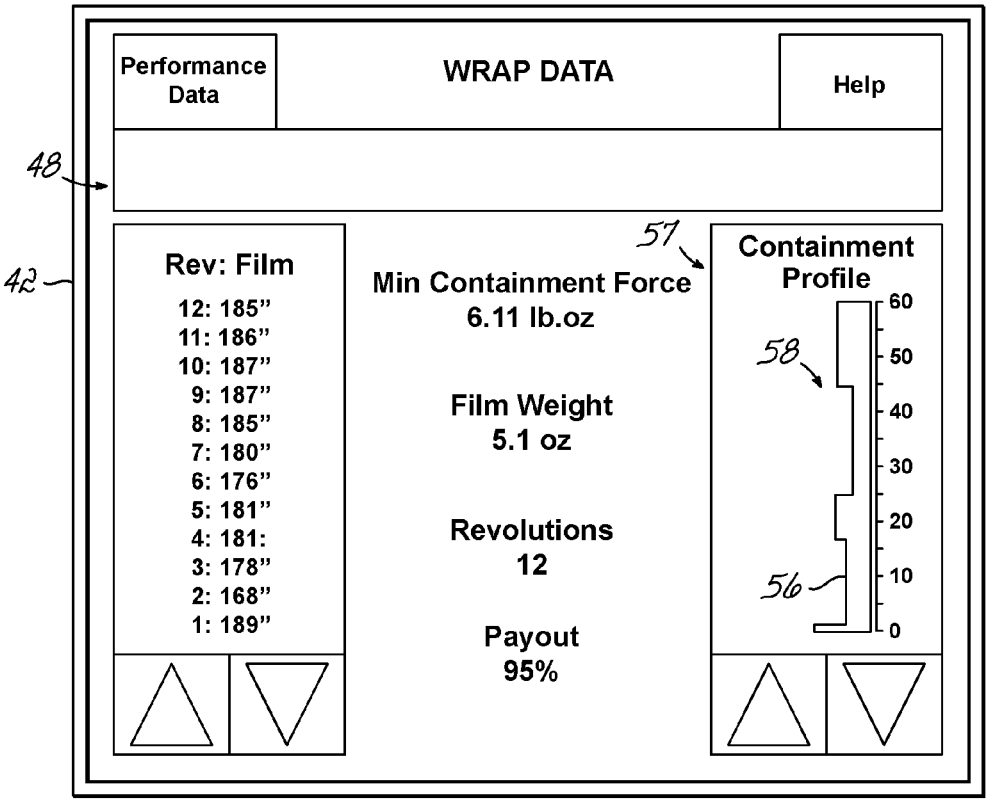
FIG. 4 is another exemplary screen shot on a display device, according to an aspect of the present disclosure.

The control system 36 (FIG. 5) may generate output signals and values, at least some of which may be displayed on a display device 42 of the wrapping machine 10. Exemplary screen shots 44, 46, and 48 from the display device 42, showing the output signals and values, are depicted in FIGS. 2-4. The display device 42 may include, for example, a touch screen display mounted on a surface of the wrapping machine 10, and/or a display on a remote electronic device, such as a computer, smartphone, or similar device. The display device 42 may also be configured to receive inputs from a user by displaying a keypad, a keyboard, a list, a table, a menu, and/or any other suitable input tool.

According to one aspect of this disclosure, methods for generating data for display on the display device 42 are provided. One of these methods is used to determine the weight of the packaging material 16 used to wrap a load so it can be displayed on the display device 42. The method includes establishing baseline weight per inch values for one or more types of packaging material. Establishing a baseline weight per inch value for the packaging material 16 may begin with performing a wrap cycle to wrap a baseline or test load with the packaging material 16. During the wrap cycle, the control system 36, using the sensing assembly 27, may determine the length of the packaging material 16 dispensed during wrapping. For example, the length of the packaging material 16 dispensed during wrapping can be calculated by multiplying the number of revolutions undergone by the roller 26 during wrapping by the circumference of the roller 26.

After the baseline load has been wrapped, the packaging material 16 wrapped around the baseline load is removed from the baseline load and is weighed on a scale. The weight of the packaging material 16 removed from the baseline load may be entered into the control system 36 using the display device 42.

The control system 36 may divide the weight of the packaging material 16 removed from the baseline load by the length of the packaging material 16 dispensed during wrapping to determine the weight per inch of the packaging material 16. The weight per inch value of the packaging material 16 may be stored in a memory location by the control system 36. It is contemplated that the above-recited steps for determining the weight per inch value of the packaging material 16 may be carried out on different types of packaging material to develop a library of weight per inch values for many different types of packaging material. The library may be accessed by the control system and/or a user.

When a user wants to wrap loads for shipping, the user may input the weight per inch value for the type of packaging material the user is using into the control system 36. The user may do so by pressing, for example, a button 52 on the display device 42, as shown in FIGS. 2 and 3. Once the button 52 has been pressed, the display device 42 may provide the user with a suitable input tool by which the user can enter the weight per inch value, and/or type in one or more identifiers associated with the packaging material so the control system 36 can obtain the weight per inch value from the library. It is also contemplated that the user may be provided with a list or menu of packaging materials on the display device 42. The user may choose the packaging material from the list or menu, and the control system 36 may obtain the corresponding weight per inch value from the library.

Once the weight per inch value has been entered, the load is wrapped. During wrapping of the load, the control system 36 may use signals from the sensing assembly 27 to determine the length of the packaging material 16 dispensed during wrapping. The length dispensed may be multiplied by the weight per inch value for the packaging material 16 to determine the weight of the packaging material 16 used to wrap the load. It should be understood that the weight per inch value remains accurate even if the load has different dimensions or characteristics than the baseline load, and/or is wrapped using a different wrapping pattern or different settings than those used to wrap the baseline load. However, if the type of packaging material being used to wrap the loads changes, the weight per inch value associated with the new packaging material can be entered into the controller 36 before wrapping subsequent loads, so that the calculated weight dispensed is accurate.

The weight of the packaging material 16 used to wrap the load may be displayed on the display device 42, as shown in FIGS. 2-4. The weight of the packaging material 16 used to wrap the previous load may be accessed by touching a button 50 on the display device 42. By this process, the user is provided with a visual indication of the weight of the packaging material 16 being used to wrap the loads for each of the wrapped loads. The user may make adjustments to the wrapping process and/or to the packaging material used, if the weight of the packaging material 16 being used is outside of a desired range of values. It is also contemplated that the control system 36 may be provided with the desired range of weight values, and if the weight of the packaging material 16 is outside of that range, a warning may be displayed on the display device 42 to alert the user. The warning may be in the form of colored text or symbols, flashing text or symbols, an audible alert and/or animations on the display device 42. Additionally or alternatively, an e-mail or other electronic communication may be sent to one or more remote electronic devices to alert the user.

It is contemplated that if the cost per weight of the packaging material 16 can be determined, the weight per inch value may be converted into a cost per inch value. Using the process described above, the cost of the packaging material 16 used to wrap the load 12 may be determined and displayed on the display device 42, with warnings being communicated to the user when the cost is outside of a desired range of values.

According to an aspect of the present disclosure, another method for generating and displaying data may include determining wrap profile data 53 and/or 57, and displaying the wrap profile data 53 and/or 57, as shown in FIGS. 2 and 4, on the display device 42. As shown in FIG. 2, the wrap profile data 53 provides the user with a visual indication of the thickness of packaging material 16 (e.g., the number of layers of the packaging material 16) wrapped onto a face of the load 12.

In order for such data to be generated and displayed, the user may first input an effective height of the packaging material 16 into the control system 36 via the display device 42. The user may input the effective height via the display device 42 in a manner similar to entry of the weight per inch value. The effective height of the packaging material 16 is a height of the packaging material 16 dispensed from the packaging material dispenser 14 as measured from a first edge of the dispensed packaging material 16 to a second edge of the dispensed packaging material 16, the second edge being opposite the first edge. The first edge and the second edge may be defined by portions of the packaging material 16 that are not roped or rolled into a cable. It is also contemplated that at least one of the first edge and the second edge may be an edge portion of a rope or rolled cable formed from the packaging material 16.

The control system 36 generates a graph 54, shown in FIG. 2, with the vertical axis of the graph 54 representing a face of the load 12 to be wrapped. The horizontal axis of the graph 54 is indicative of the thickness of packaging material 16 on the face of the load 12. As the load 12 is wrapped, the control system 36, using signals from the sensing assemblies 40 and 38, monitors the number of relative revolutions of the packaging material dispenser 14 and the height of the packaging material dispenser 14 relative to the load 12 at which the revolutions take place. By using this information, as well as the effective height of the packaging material 16, one or more bars 56 or other suitable indicators may be generated along the horizontal axis of the graph 54.

For example, during wrapping, packaging material having a twenty inch effective height may be used to wrap the load 12. Based on the signal from the sensing assembly 38, the control system 36 may determine the height on the face of the load 12 at which the packaging material is dispensed and applied to the face of the load 12. Based on the signal from the sensing assembly 40, the control system 36 can determine the number of relative rotations of the packaging material dispenser 14 relative to the load 12 at each height during wrapping. Thus, if the control system 36 determines, based on the signal from the sensing assembly 38, that the bottom twenty inches of the load 12 is being wrapped, and that, based on the signal from the sensing assembly 40, there have been three relative rotations between the packaging material dispenser 14 and the load 12 at that height, the control system 36 will update the graph 54 to display three bars on the horizontal axis for each unit of height on the vertical axis between 0 and 20 (representing the portion of the face of the load 12 between a bottom edge of the load 12 and a point twenty inches above the bottom edge).

If the control system 36 determines that the fourth relative revolution is performed with the packaging material dispenser 14 at a height relative to the load 12 indicating that the relative revolution took place with the packaging material dispenser 14 wrapping the portion of the load 12 between ten and thirty inches from the bottom of the load 12, the control system 36 will update the graph 54 by adding one bar on the axis for each unit of height on the vertical axis between 10 and 30, such that there would be three bars on the horizontal axis at the unit of height between 0 and 10 on the vertical axis, four bars on the horizontal axis for each unit of height between 10 and 20 on the vertical axis, and one bar on the horizontal axis for each unit of height between 20 and 30. This process is carried out throughout wrapping of the load 12 to generate a profile of the thickness of packaging material 16 on the face of the load 12. In FIG. 2, the bars 56 on the graph 54 display an exemplary profile associated with a wrapped load, and not necessarily the wrapped load from the example above.

It is contemplated that the user can input data into the control system 36 indicating that an edge portion of the packaging material 16 includes a rope or rolled cable of film, similar to that which is described in U.S. Pat. No. 7,568,327 and U.S. Patent Application Publication No. 2007/0209324. Additionally or alternatively, a sensing assembly (not shown) may be provided on the wrapping machine 10 that can determine whether a drive down and roping assembly, similar to that which is described in U.S. Pat. No. 7,568,327 and U.S. Patent Application Publication No. 2007/0209324, has been actuated during wrapping to rope or roll the packaging material 16. The control system 36 may use this information when updating the graph 54. For example, if the control system 36 is informed that an edge portion of the twenty inch high packaging material 16 includes a rope or rolled cable, giving the edge portion added thickness, the control system may add multiple bars on the horizontal axis of the graph 54 at the height on the vertical axis corresponding to the height on the face of the load 12 at which the rope or rolled cable is applied, while adding a single bar on the horizontal axis for heights on the vertical axis corresponding to portions on the face of the load 12 at which a non-roped or non-rolled portion of the packaging material 16 is applied. For example, when the bottom twenty inches of the load 12 is being wrapped with twenty-inch high packaging material 16 that includes a rope or rolled cable at its bottom edge, for each relative revolution between the packaging material dispenser 14 and the load 12, the control system may add multiple bars on the horizontal axis for each unit of height between 0 and 1 on the vertical axis while adding one bar on the horizontal axis for each unit of height between 1 and 20 on the vertical axis of the graph 54.

Since each layer of packaging material 16 exerts a force on the surface of the load 12, it should be understood that the profile displayed on the graph 54 is indicative of the thickness or number of layers of packaging material 16 on the face of the load 12, as shown in FIG. 2, and is also indicative of the force exerted on the face of the load 12 by the packaging material 16 wrapped thereon. Thus, a graph 58 shown in FIG. 4 may be generated in a manner similar to the graph 54 of FIG. 2. In FIG. 4, the bars 56 on the graph 58 display an exemplary profile associated with a wrapped load, and not necessarily the same wrapped load that produced the profile shown in FIG. 2. It should be understood, however, that if graphs 54 and 58 are generated based on the same wrapped load, the bar profiles on the graphs may be substantially identical.

By displaying the graphs 54 and/or 58 on the display device 42, the user is able to see the distribution of packaging material 16 and/or force on the face of the load 12 easily. The user may be able to identify areas of excess packaging material 16 and/or force, areas of undesirably low packaging material coverage and/or force, and areas that have not been covered at all by packaging material 16 and have no containment force acting thereon. For example, areas of lower packaging material coverage and/or the area with the lowest packaging material coverage may be highlighted on the graphs 54 and/or 58 using different colored bars, text, symbols, an audible alert, and/or animation to catch the attention of an observer.

The user may use this information to make adjustments to wrapping parameters to achieve a more desirable profile. For example, the user (and/or any other machine operator) may adjust the wrapping pattern for wrapping a subsequent load based on the graphs 54 and/or 58 for a previously wrapped load by having the packaging material dispenser 14 dispense more of the packaging material 16 at areas of the load 12 to be wrapped corresponding to areas on the graphs 54 and/or 58 with a lower number of bars than other areas, and less of the packaging material 16 at areas of the load 12 to be wrapped corresponding to areas on the graphs 54 and/or 58 with a higher number of bars than other areas.

According to an aspect of this disclosure, another method for generating and displaying data may include determining the area on the face of a wrapped load at which the packaging material 16 is exerting the least force on the load 12. Identifying the location and characteristics of this area is desirable since it provides an indication of the area of the wrapped load at which failure of the packaging material 16 is most likely to occur. As long as the force at that area is in a desired range, the user can be assured that the probability of packaging material failure during shipping of a wrapped load has been minimized or at least reduced to an acceptable level of risk.

One or more baseline values can be found by inputting a girth of a baseline or test load and setting the wrapping machine 10 to wrap the baseline load at a payout percentage of 100%. A payout percentage of 100% means that the length of packaging material 16 dispensed during one relative revolution of the packaging material dispenser 14 relative to the baseline load is equal to the girth of the baseline load. The girth may be found by manually measuring dimensions of the load 12, by sensing boundaries of the load 12 with sensing devices, and/or by any other suitable method. The girth may be entered using the display device 42 by accessing an input tool via a button 60 on the display device 42 shown in FIGS. 2 and 3. The payout percentage is a measure of the length of packaging material 16 dispensed during one relative revolution divided by a girth of the load 12 to be wrapped. The payout percentage value for wrapping the baseline load can be input into the control system 36 by using the button 52 on the display device 42 to access any suitable input tool.

A containment force measuring device (not shown) like the one described in U.S. Pat. No. 7,707,901 can be used to take a measurement of the containment force at a point on the wrapped baseline load may be taken. The point may be at the top of the wrapped baseline load, for example. The containment force value may be entered into the control system 36 using any suitable input tool accessed by touching a button 51 on the display device 42 shown in FIG. 3. The control system 36 may determine the number of relative revolutions the packaging material dispenser 14 made relative to the baseline load during wrapping at the measurement point, which is indicative of the number of layers of packaging material 16 on the face of the wrapped baseline load at the measurement point. The control system 36 may divide the measured containment force value by the number of relative revolutions to determine the containment force exerted by each layer of the packaging material 16 at the measurement point, thus arriving at the force per relative revolution or layer of the packaging material 16. The calculated force per relative revolution value is a baseline value usable in other calculations. It should be understood that a library of baseline values with values categorized based on wrapping conditions may be stored by the control system 36, and thus, the baseline values would be available for selection by the user from a list or menu (not shown) without requiring wrapping a baseline load.

When the user wants to wrap a load 12 for shipping, the control system 36 will have already been provided with the baseline force per relative revolution value, as well as the girth of the load 12 being wrapped. Based on signals from the sensing assemblies 27 and 40, the control system may determine the amount of packaging material 16 dispensed during a relative revolution between the packaging material dispenser 14 and the load 12. The control system 36 may calculate the payout percentage value at which the load 12 is being wrapped by dividing the amount dispensed during the relative revolution by the girth of the load 12. The calculated payout percentage may be displayed on the display device 42, as shown in FIGS. 2-4.

The control system 36 may determine the containment force per revolution or layer of packaging material applied to the load 12 during wrapping by starting with the baseline force per relative rotation value and adjusting it by a factor based on the difference between the payout percentage of 100% used to determine the baseline force per relative rotation value and the calculated payout percentage. Adjustment is necessary because if the calculated payout percentage is greater than 100%, a greater amount of material is being dispensed per relative rotation than when wrapping at 100%, and thus, each layer wrapped at 110% exerts less force on the load 12 than the layers wrapped at 100%. It is contemplated that for calculated payout percentages over 100%, the baseline force per relative revolution may be multiplied by a factor calculated by taking a difference between the baseline force per relative revolution and the calculated payout percentage, subtracting that from 100%, and dividing by 100. In this example, the factor would be 0.9.

On the other hand, if the calculated payout percentage is 90%, a smaller amount of packaging material 16 is being dispensed per relative rotation than when wrapping at 100%. Thus, each layer wrapped at 90% exerts more force on the load 12 than the layers wrapped at 100%. It is contemplated that for calculated payout percentages under 100%, the baseline force per relative revolution may be multiplied by a factor calculated by taking a difference between the baseline force per relative revolution and the calculated payout percentage, adding that to 100%, and dividing by 100. In this example, the factor would be 1.1.

During wrapping of the load 12, the control system 36 may update the graph 54 and/or the graph 58 such that the user is able to view the wrap profile for the wrapped load when wrapping has been completed. The control system 36 may also flag the height on the graph 54 and/or the graph 58 having the least number of bars, that flagged height being indicative of a comparatively weaker area on the wrapped load, and store the number of bars at the weaker area in memory. The control system 36 may calculate the minimum containment force on the wrapped load by multiplying the containment force per revolution or layer of packaging material by the number of bars or layers in the weaker area. It is also contemplated that the weaker area may be highlighted on the display device 42 by, for example, the use of color, text, animation, an audible alert and/or any other suitable identifiers to inform a viewer of the location or presence of the weaker area on the graph 54 and/or the graph 58. The control system 36 may display the minimum containment force on the display device 42, as shown in FIGS. 3 and 4.

By this process, the user is provided with a visual indication of the minimum containment force on each of the wrapped loads. The user may make adjustments to the wrapping process and/or to the packaging material used, if the minimum containment force is outside of a desired range of values, such as a known range of values that typically survive being transported. It is also contemplated that the control system 36 may be provided with the desired range of values, and thus, if the minimum containment force is outside of that range, a warning may be displayed on the display device 42 to alert the user. The warning may be in the form of colored text or symbols, flashing text or symbols, an audible alert, and/or animation on the display device. Additionally or alternatively, an e-mail or other electronic communication may be sent to remote electronic devices to alert the user.

The user may use this information to make adjustments to wrapping parameters to achieve a more desirable profile. For example, the user (and/or any other machine operator) may adjust the wrapping pattern for wrapping a subsequent load based on the graphs 54 and/or 58 for a previously wrapped load by having the packaging material dispenser 14 dispense more of the packaging material 16 at the area associated with the minimum containment force, and less of the packaging material 16 at other areas. It is contemplated that the control system 36 may take an average of the number of bars for a range of heights that includes the height having the least number of bars or minimum containment force. For example, the control system 36 may take an average of the number of bars for a range extending four inches above and below the height having the least number of bars, identify that entire range as the weaker area, and multiply that average number of bars for the range by the containment force per revolution to calculate the minimum containment force. The entire range may be identified by highlighting, text, symbols, an audible alert and/or animation, making it easier for a machine operator to be aware of see where weaker areas exist, and set the wrapping pattern to compensate due to the weaker area forming a larger target.

As shown in the screen shots 44 and 48 of FIGS. 2 and 4, the length of the packaging material 16 dispensed during each relative revolution between the packaging material dispenser 14 and the load 12 may be displayed for viewing by the user. Data for the length dispensed during each relative revolution may come from the sensing assembly 27, which provides the control system 36 with data on the length of the packaging material 16 dispensed, and the sensing assembly 40, which provides the control system 36 with data on the relative revolutions of the packaging material dispenser 14 relative to the load 12. Using the sensing assemblies 32 and 40, the control system 36 can determine when a relative revolution starts and ends, and how much packaging material 16 was dispensed during that relative revolution. That information may then be displayed on the display device 42.

Displaying such information serves a diagnostic function, allowing a machine operator or observer to determine whether the amount of the packaging material 16 dispensed per relative revolution, and per load girth, is within a desired range. For example, an observer may compare the amount of the packaging material 16 dispensed per relative revolution to the load girth to see if the commanded payout percentage is being met. Additionally or alternatively, the display device 42 may also show whether a variation in load girth has been encountered during wrapping. The display device 42 may also show variations in payout during different relative revolutions. For example, the display device 42 may show that the payout of the packaging material 16 is different during the first and/or last relative revolutions, as compared to the relative revolutions therebetween, to set up the packaging material 16 for proper clamping, cutting, and wiping. It is also contemplated that summing the lengths shown in the display device 42 may provide the input for calculations requiring data on the length of the packaging material 16 dispensed, such as the packaging material weight calculation described in preceding paragraphs.

While the present invention has been illustrated by the description of one or more embodiments thereof, and while the embodiments have been described in considerable detail, they are not intended to restrict or in any way limit the scope of the appended claims to such detail. The various features shown and discussed herein may be used alone or in combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A wrapping machine for wrapping a load with packaging material, comprising:

a packaging material dispenser configured to dispense packaging material around the load;

at least one sensing assembly sensing a plurality of relative revolutions between the packaging material dispenser and the load and a height of the packaging material dispenser relative to the load during each relative revolution among the plurality of relative revolutions when wrapping the load with packaging material;

a display device; and a controller communicating with the sensing assembly and the display device to determine a height of the packaging material dispenser during each of the plurality of relative revolutions when wrapping the load with packaging material;

the controller determining the number of layers applied to a face of the load at a plurality of heights on the load based on an effective height of the packaging material as measured between first and second edges of the packaging material, the sensed relative revolutions and the determined height of the packaging material dispenser during each of the plurality of relative revolutions, wherein the number of layers applied to the face of the load at the plurality of heights is representative of a thickness of packaging material applied to the face of the load at the plurality of heights; and the controller further using the determined number of layers applied to the face of the load at the plurality of heights to generate information representative of the number of layers applied to the face of the load at one or more of the plurality of heights and controlling the display device to display the information representative of the number of layers applied to the face of the load at the one or more of the plurality of heights.

2. The wrapping machine of claim 1, wherein:

the at least one sensing assembly further senses a length of packaging material dispensed during wrapping of the load;

the controller determines at least one parameter associated with the packaging material dispensed to the wrapped load based on the sensed length and a value for a characteristic associated with the packaging material, the value obtained by measuring the characteristic on packaging material applied to a test load; and the controller controls the display device to display the at least one parameter.

3. The wrapping machine of claim 2, wherein:

the characteristic is indicative of a containment force exerted on the test load by one layer of the packaging material; and the at least one determined parameter is a containment force exerted by the packaging material on the wrapped load.

4. The wrapping machine of claim 2, wherein the controller further controls the display device to display information related to the length of packaging material dispensed.

5. The wrapping machine of claim 2, wherein:

the characteristic is indicative of at least one of a weight of the packaging material per unit of length, or a cost of the packaging material per unit length; and the at least one determined parameter is at least one of a weight or a cost of the packaging material dispensed to the wrapped load.

6. The wrapping machine of claim 1, wherein:

the controller controls the display device to display a graph including an axis representative of the face of the load, and at least one indicator along the axis representative of the number of layers on the face of the load at the plurality of heights.

7. A wrapping machine for wrapping a load with packaging material, comprising:

a packaging material dispenser configured to dispense packaging material around the load;

at least one sensing assembly sensing relative revolutions between the packaging material dispenser and the load and a height of the packaging material dispenser relative to the load during each relative revolution;

a display device; and a controller communicating with the sensing assembly and the display device, and controlling the display device to display information related to the sensed relative revolutions;

wherein the controller determines the number of layers applied to a face of the load at one or more heights based on the sensed relative revolutions, wherein the number of layers applied to the face of the load at the one or more heights is representative of a thickness of packaging material applied to the face of the load at the one or more heights;

wherein the controller determines a value of a containment force exerted on the load by the applied layers at the one or more heights based on the determined number of layers and a value indicative of an individual containment force exerted on the load by each layer; and wherein the controller controls the display device to display information related to the determined value of the containment force exerted on the load by the applied layers at the one or more heights.

8. The wrapping machine of claim 7, wherein:

the controller controls the display device to display a graph including an axis representative of the face of the load, and at least one indicator along the axis representative of the number of layers on the face of the load at the one or more heights.

9. The wrapping machine of claim 2, wherein the controller further:

initiates a wrap cycle to apply packaging material to the test load;

determines a length of packaging material dispensed during the wrap cycle;

receives entry of a measurement taken from packaging material applied to the test load during the wrap cycle; and determines the value for the characteristic from the determined length of packaging material dispensed during the wrap cycle and the received measurement.

10. The wrapping machine of claim 7, wherein the controller determines the value indicative of the individual containment force exerted on the load by each layer by adjusting a baseline individual containment force value based upon a length of packaging material dispensed during a relative revolution between the packaging material dispenser and the load.

11. The wrapping machine of claim 10, wherein the controller further:

initiates a wrap cycle to apply packaging material to a test load;

determines the number of layers applied to a face of the test load at one or more heights during the wrap cycle;

receives entry of a containment force measurement taken from packaging material applied to the test load during the wrap cycle; and determines the baseline individual containment force value from the determined number of layers applied to the face of the test load at the one or more heights during the wrap cycle the received containment force measurement.

12. The wrapping machine of claim 7, wherein the determined value of the containment force exerted on the load by the applied layers includes a minimum containment force on the load.

13. The wrapping machine of claim 12, wherein the controller further controls the display device to indicate a height associated with the minimum containment force on the load.

14. The wrapping machine of claim 7, wherein:

the controller determines a plurality of values of the containment force exerted on the load at a plurality of heights, and the controller controls the display device to display a graph including an axis representative of the face of the load, and at least one indicator along the axis representative of the determined plurality of values of the containment force.

15. A wrapping machine, comprising:

a packaging material dispenser dispensing packaging material around a load;

a relative rotation assembly providing relative rotation between the packaging material dispenser and the load;

a vertical drive assembly providing relative vertical movement between the packaging material dispenser and the load during the relative rotation to spirally wrap the packaging material around the load;

at least one sensing assembly sensing relative revolutions between the packaging material dispenser and the load and a height of the packaging material dispenser relative to the load during each relative revolution;

a display device; and a controller coupled in communication with the relative rotation assembly, the drive assembly and the display device to perform a wrap cycle that applies a plurality of layers of packaging material to a face of the load, wherein the controller further:

determines a height associated with each of the plurality of layers;

determines a value of an individual containment force exerted on the load by each of the plurality of layers; and controls the display device to display a graph including an axis representative of the face of the load, and at least one indicator along the axis representative of a number of layers of packaging material or a containment force applied to the load at a plurality of heights along the face of the load.

16. The wrapping machine of claim 15, wherein the at least one indicator is representative of the number of layers on the face of the load at the plurality of heights, wherein the number of layers applied to the face of the load at the plurality of heights is representative of a thickness of packaging material applied to the face of the load at the plurality of heights.

17. The wrapping machine of claim 15, wherein the at least one indicator is representative of the containment force applied to the load at the plurality of heights, wherein the controller determines the containment force applied to the load at each of the plurality of heights by combining the determined values of the individual containment force of one or more layers applied to the load at such height.

* * * * *